United States Patent [19]

Young et al.

[11] Patent Number: 4,794,744

[45] Date of Patent: Jan. 3, 1989

[54] WALL CONSTRUCTION FOR MODULAR WOVEN WIRE PARTITION

[75] Inventors: Ronald A. Young; Gregory C. Young, both of Denver, N.C.

[73] Assignee: Young Holdings Ltd. Corp., Sterling, Mass.

[21] Appl. No.: 151,163

[22] Filed: Feb. 1, 1988

[51] Int. Cl.[4] ..... E04B 1/00

[52] U.S. Cl. ..... 52/282; 52/239; 52/489; 256/24

[58] Field of Search ..... 52/281, 489, 282, 239; 256/24, 56, 73; 160/371

[56] References Cited

U.S. PATENT DOCUMENTS

| | | | |
|---|---|---|---|
| 2,529,648 | 11/1950 | Borton | 52/282 X |
| 3,228,157 | 1/1966 | Jacobson | 52/239 |
| 3,734,467 | 5/1973 | Weeden | 256/24 X |
| 3,839,834 | 10/1974 | Goddard | 256/24 X |
| 4,063,714 | 12/1977 | Kirkwood | 256/24 |
| 4,083,535 | 4/1978 | Britt | 256/24 |
| 4,188,019 | 2/1980 | Meredith | 256/24 |
| 4,225,120 | 9/1980 | McLaughlin | 256/24 |
| 4,428,172 | 1/1984 | Larsson | 52/489 |
| 4,623,128 | 11/1986 | Dutch et al. | 256/73 X |
| 4,704,835 | 11/1987 | Jordan | 52/489 X |

*Primary Examiner*—Carl D. Friedman

*Attorney, Agent, or Firm*—Samuels, Gauthier, Stevens & Kehoe

[57] ABSTRACT

A wall construction for a modular woven wire partition, comprising: a plurality of laterally spaced vertically disposed fixed support posts, each support post having a mounting surface with a plurality of vertically spaced openings therein; a plurality of panels arranged vertically in a coplanar relationship between the support posts, each panel having a rectangular configuration bordered by top, bottom and side frame members, at least the top and bottom frame members of each panel having open ends; and a plurality of connector elements received in the open ends of at least the top frame members of the panels, the connector elements being engageable with the openings in the mounting surfaces of the support posts to thereby connect the panels to the support posts.

12 Claims, 4 Drawing Sheets

WALL CONSTRUCTION FOR MODULAR WOVEN WIRE PARTITION

BACKGROUND OF THE INVENTION

1. Field of the Invention

This invention relates to a wall construction for modular woven wire partitions.

2. Description of the Prior Art

Modular wovenwire partitions are conventionally made up of individual rectangular panels arranged vertically one above the other as well as side by side in a horizontally adjacent relationship. during erection, the horizontally adjacent panels are bolted together. This is an extremely time consuming operation which adds significantly to the oerall cost of an installation.

A primary objective of the present inention is to obviate thenecessity for bolting horizontally adjacent panels together, thereby reducing erection time, with a concommitant savings in installation costs.

SUMMARY OF THE INVENTION

The wall construction of the present inention includes a pluarlity of vertically disposed fixed support posts, each having a mounting face with a plurality of vertically spaced openings therein. The rectangular panels are adapted to be arranged vertically one above the other between pairs of the support posts. Each panel is bordered by top, bottom and side frame members, with at least the top and bottom frame members having generally channel-shaped cross sections with open ends. Connector elements are driven into the open ends of at least the top frame members of each panel. The connector elements are engageable with the openings in the mounting surfaces of the support posts, thereby enabling quick assembly of the panels one above the other between the support posts with horizontally adjacent panels being connected to common support pots arranged therebetween.

DETAILED DESCRIPTION OF ILLUSTRATED EMBODIMENT

Figure 1:
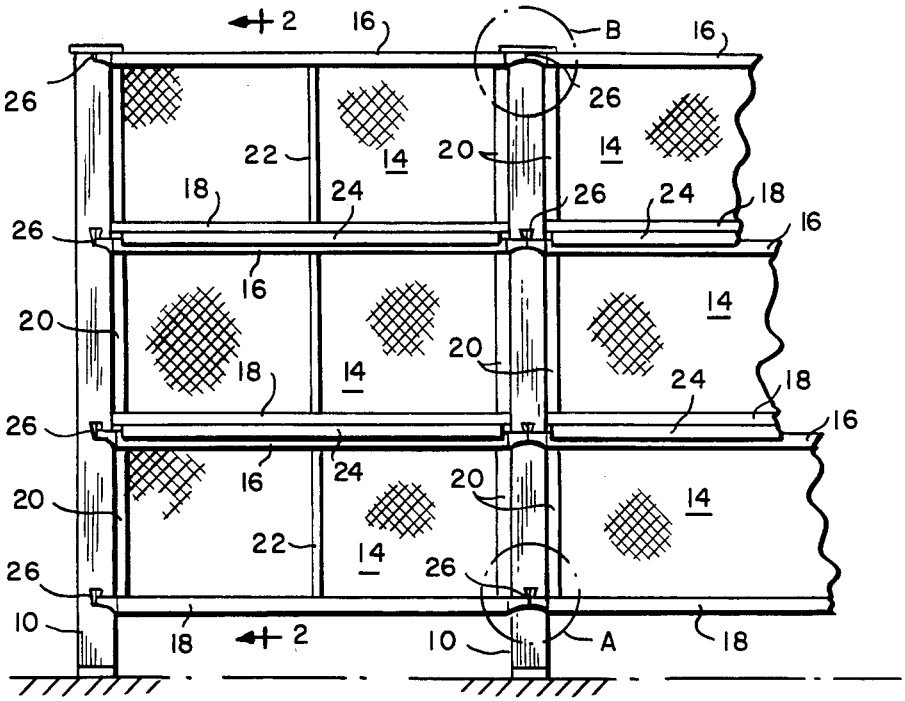
FIG. 1 is an exterior elevational view of a portion of a wall construction i accordance with the present invention.
Figure 2:
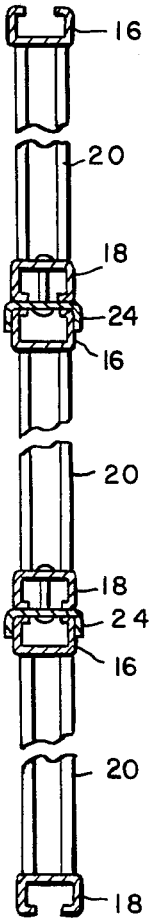
FIG. 2 is a sectional view taken along line 2—2 of FIG. 1.
Figure 10:
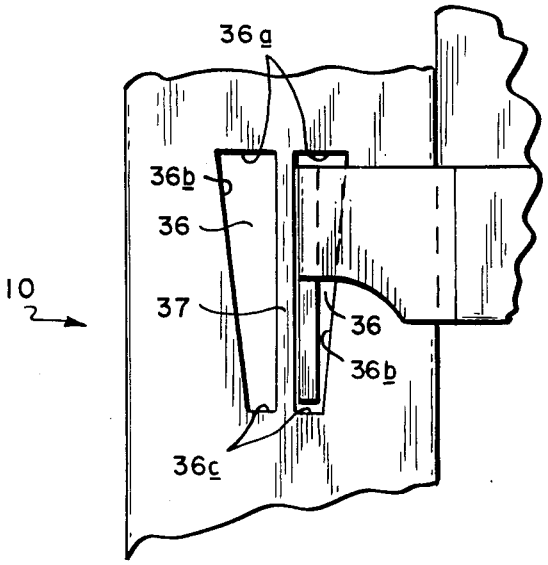
FIG. 10 is a view of a connector element shown in an intermediate stage of its assembly onto a support post.

Referring initially to FIGS. 1 and 2, a modular woven wire partition having a wall construction in accordance with the present invention is shown comprising a plurality of laterally spaced vertically disposed support posts 10 fixed to the floor 12 by any convenient means, typically by anchor bolts or the like (not shown). A pluarlity of panels 14 are arranged vertically in a coplanar relationship between the support posts. The number pf panels may vary widely, depending on the desired height of the partition. Here, three anels are shown vertically arranged for illustrative purposes.

Each panel has a rectangular configuration bordered by top 16, bottom 18, and side 20 frame members. Woven wire screening is stretched between and secured to the frame members, and where appropriate, intermediate stiffeners 22 are added between the top and bototm frame members 16, 18. At least the top and bottom frame members 16, 18 are provided with generally channel-shaped cross sections. All ut the lowermost panels have channel-shaped caps 24 secured to the underside of their bottom frame members 18.

the ends of the top and bottom frame members 16, 18 of the lowermost panels are attached to the support posts 10 as at 26. The intermediate panels have their caps 24 seated on the top frame members 16 of the lowermost panels, thus requiring that only the ends of their top frame members 16 be connected to the support posts 10 as at 26. The same is true for the upper panels.

Each support post 10 preferably comprises a hollow box beam with a front mounting surface 30 and with side surfaces 32 extending rearwardly from the mounting surface to a back surface 34. Each front mounting surface 30 has a plurality of vertically spaced pairs of openings 36 separated by intermediate webs 37. Each opening has a relatively wide top edge **36*a* with an inclinded side edge 36*b* tapering downwardly and inwardly to a narrower bottom edge 36*c*. Similar openings 36'** are provided at the uppermost ends of the support posts, except that here the tops of the openings are open.

Figure 5:
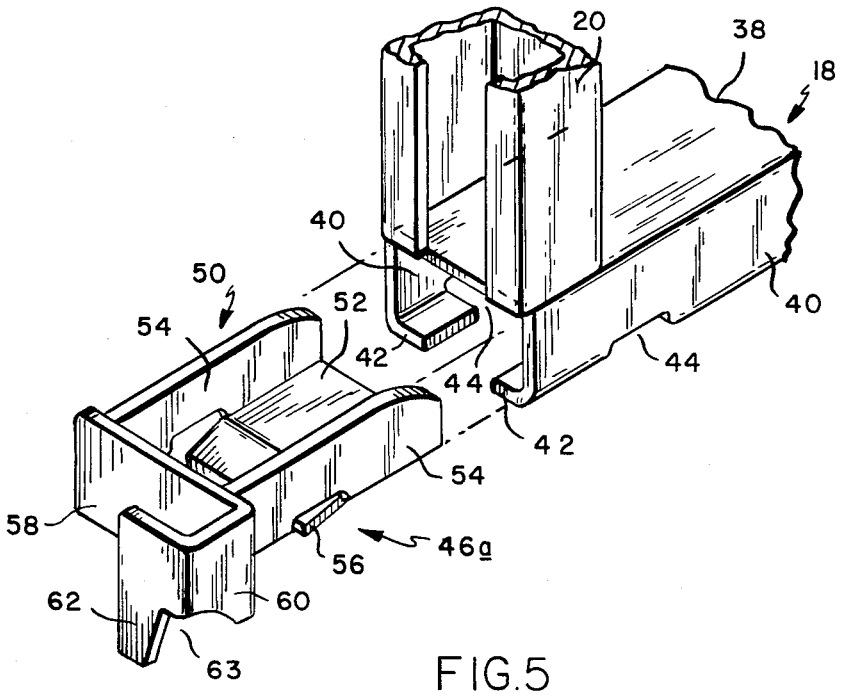
FIG. 5 is an exploded perspective view of a connector element and an end of a bottom frame member.
Figure 8:
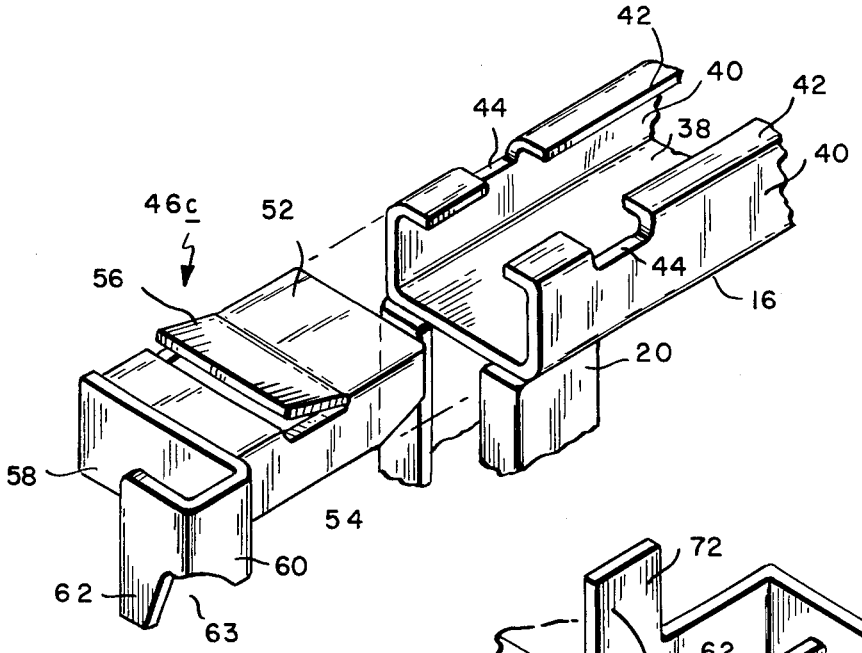
FIG. 8 is an exploded perspective view of a connector element and an end of a top frame member.

As can best be seen in FIG. 5, each bottom frame member 18 is open ended,with a downwardly opening channel-shaped cross section defined by a base wall 38 and confronting side walls 40 which terminate in peripheral inturned flanges 42. The flanges 42 are cut away at locations spaced inwardly from the frame ends to provide locking notches 44. As shown in FIG. 8, the top frame members 16 are identically constructed, except that here the channel-shaped cross sections open upwardly.

Figure 9:
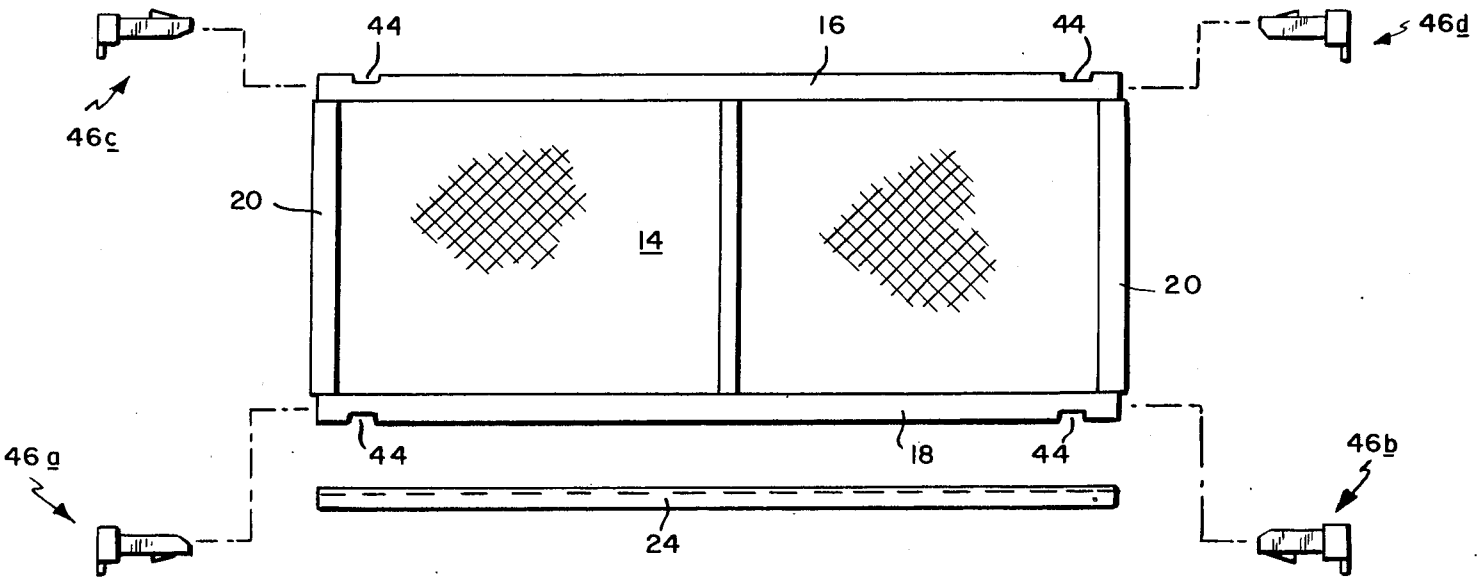
FIG. 9 is a somewhat schemtic exploded illustration of a typical panel and the accessories which may be employed therewith.

As shown in FIG. 9, a connector element **46*a* is adapted to be assembled into the left-hand end of the lower frame member 18. As can be best seen in FIG. 5, the connector element 46*a* has a channel shaped shank 50 defined by a base wall 52 and side walls 54. An angled somewhat resilient tongue 56 is stamped out of the base wall 52. A face plate 58 closes off one end of the shank 50. The face plate has an integral perpendicular ear 60 which terminates in a tab 62 extending downwardly below the level of the base wall 52. The juncture of the ear 60 and tab 62 is cut away as at 63**.

The shank 50 is adapted to be driven into the open end of the frame member. When received in the frame member, the tongue 56 coacts in an interlocked relationship withthe locking notches 44, as shown by the broken away portion in FIG. 3, thereby preventing subseuent separation of the end connector from the frame member. The face plate 58 closes off the open end of the frame member.

With reference to FIG. 9, and as previously indicated, the connector element 46*a* is specially adapted and configured to be driven into the left-hand end of the lower frame member 18. A mirror image connector element 46*b* is provided for the right-hand end of the lowr frame member. As shown in FIG. 8, a similarly configured connector element 46*c*, is provided for the left hand end o the upper frame member 16, except that here the shank 50 is inverted, i.e., it opens downwardly rather than upwardly. Again with reference to FIG. 9, it will be understood that connector element 46*c* has a mirror image element 46*d* adapted to be driven into the right hand end of upper frame member 16.

The method of assembling the wall construction is as follows: beginning with the lowermost panels, connector elements 46*a*,46*b*,46*c* and 46*d* are driven into the open ends of the lower and upper frame members at the positions schematically depicted in FIG. 9. The panel member is then positioned between the support posts 10, with the ears 60 overlapping the front mounting surface 30, and with the tabs 62 of the connector elements located within their respective openings 36 at the level illustrated in FIG. 9. The panel is then dropped relative to the support posts, thereby allowing the tabs 62 to descend behind the lower edges 36*c* of the openings 36 to establish a firmly interlocked relationship behind the mounting surface 30. The tabs 62 coact frictionally with the inclined side edges 36*b* of the openings 36 as the panels are dropped into place.

An intermediate panel is next readied for assembly by driving connector elements 46*c*,46*d* into the left and right hand ends of its upper frame member 16. The lower frame member 18 has a cap 24 secured to its underside.

The intermediate panel is then located between the support posts, with its cap 24 arranged above the top frame member 16 of the underlying panel, and with the tab members 62 of its upper connector elements 46*c*,46*d* at the level shown in FIG. 9. The panel is then dropped to mechanically seat its cap 24 on the top frame member 16 of the underlying panel, as shown in FIG. 2. At the same time, the tab members 62 of its connector elements drop into mechanical engagement within their respective openings 36.

The uppermost panel is next readied for assembly by driving connector elements 46*c*,46*d* into the left and right-hand ends of the upper frame member 16. Assembly then takes place in the same manner as with the intermediate panel.

Figure 7:
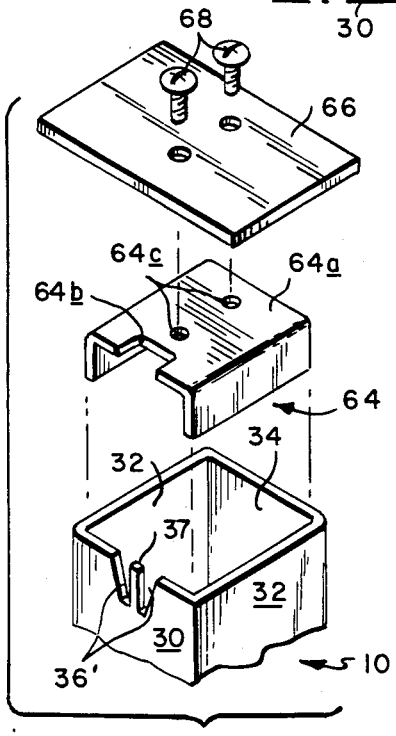
FIG. 7 is an exploded view of the components which are assembled onto the top end of the support posts.
Figure 6:
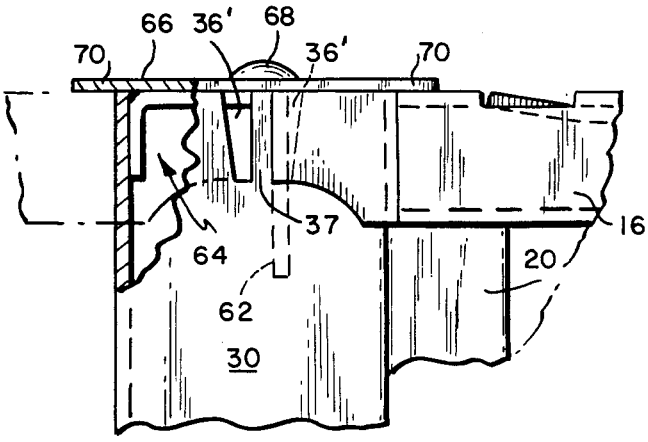
FIG. 6 in an enlarged partially broken away view of the circled area designated "B" in FIG. 1.

At this point, and with reference to FIGS. 6 and 7, it will be seen that the upper end of each support post 10 is closed off by an insert 64 welded inplace. The top surface 64*a* of the insert has anotch 64*b* opening towards the openings 36' in the front mounting surface 30, and in addition has one or more threaded openings 64*c*. The notch 64*b* accommodates entry of the connector elemenet tabs 62 into the openings 36' when positioning the uppermost panels.

A keeper plate 66 is then placed over the upper end of the support post and is fastened in place with security screws 68. The plate has side edges which overlap the top frame members 16 of the uppermost panels as at 70, thereby safeguarding the wall structure against unauthorized disassembly.

Figure 3:
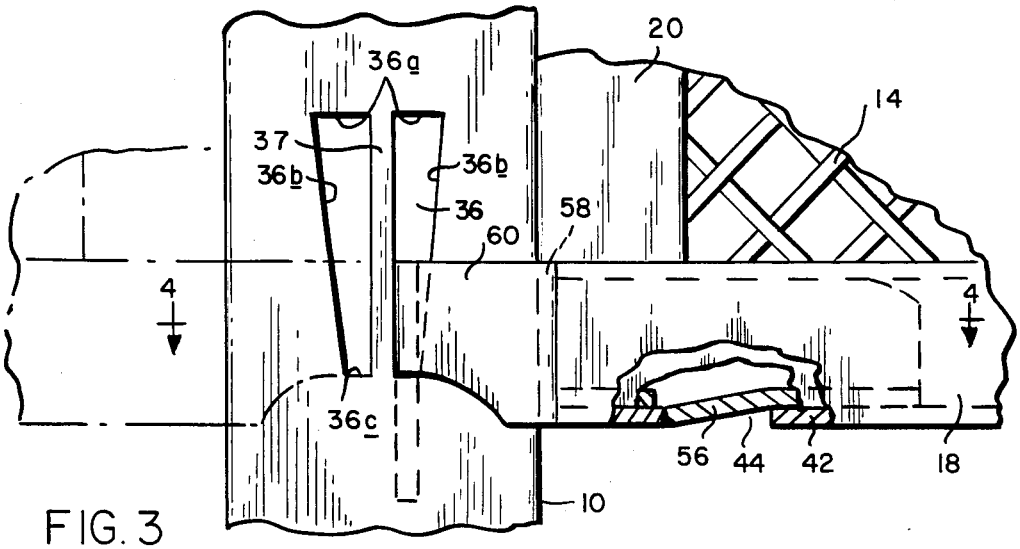
FIG. 3 is an enlarged view of the circled area designated "A" in FIG. 1.
Figure 4:
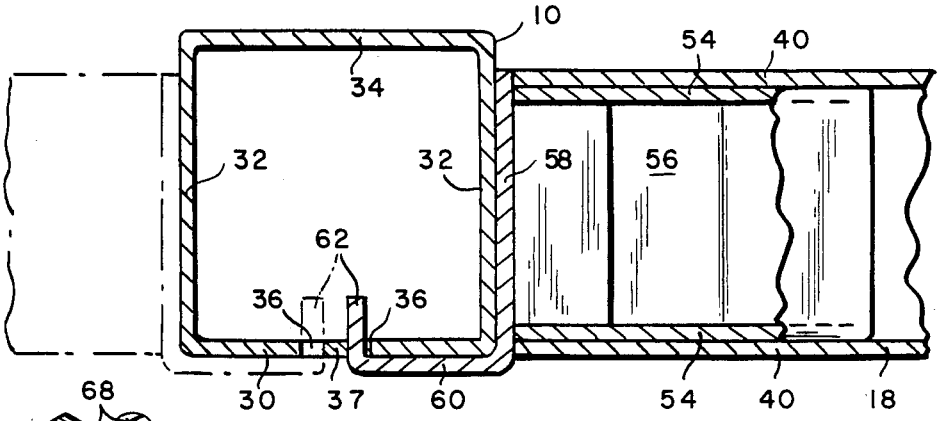
FIG. 4 is a horizontal sectional view taken along line 4—4 of FIG. 3.

The assembly procedure is repeated for each vertical row of panels, with the pairs of openigns 36 or 36' serving to accommodate the tabs of connector elements on horizontally adjacent panels, as shown by the dot-dash lines in FIGS. 3, 4 and 6.

Figure 11:
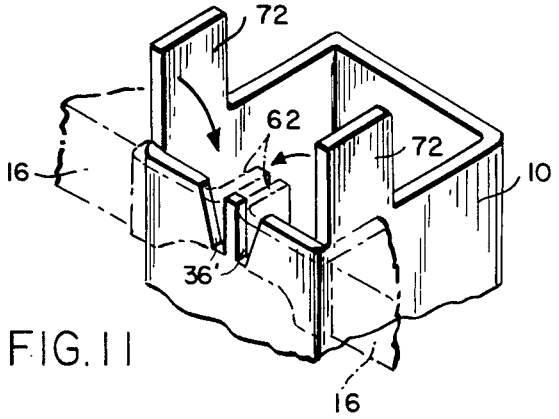
FIG. 11 is a perspective view showing an alternate and somewhat simplified arrangement for securing the uppermost panels in place.

An alternate arrangement for securing the uppermost panels in place is disclosed in FIGS. 11. Here, the support post 10 is provided at its upper end with upwardly protruding bendable extensions 72. After the tabs 62 of the connector elements in the top fram members 16 have been received in the openings 36', the extensions 72 are simply bent downwardly and inwardly, as indicated diagrammatically by the arrows, to thereby overlap the tabs 62 and thus prevent subsequent lifting and removal of the uppermostpanels.

In light of the foregoing, it will be appreciated by those skilled in the art that the present invention makes it possible to rapidly assembly a modular woven wire partition with a minimum number of personnel, thereby making it possible to realize significant savings in installation costs.

We claim:

1. A wall construction for a modular woven wire partition, comprising:

a plurality of lateraly spaced vertically disposed fixed support posts, each support post having a mounting surface with a plurality of vertically spaced openings therein;

a plurality of panels arranged vertically in a coplanar relationship between said support posts, each panel having a rectangular configuration bordered by top, bottom and side frame members, at least the top and bottom frame members of each panel having open ends; and a plurality of connector elements received in the open ends of at least the top frame members of said panels, said connector elements being engageable with the openings in the mounting surfacesof said support posts to thereby connect said panels to said support posts.

2. The wall construction of claim 1 wherein at least three of said panels are vertically arranged one above the other, the lowermost of said panels having its top and bottom frame members connected to said support posts by means of said connector elements, thte remainder of said panels having their top frame members connected to said support posts by means of said connector elements and having their bottom frame members engaged with the top frame members of the respective underlying panels.

3. The wall construction of claim 1 wherein each support post comprises a hollow box beam having side surfaces extending rearwardly from said mounting surface to a back surface.

4. The wall construction of claim 3 wherein said connector elements have face plates closing off the ends of the frame members in which they are received, said face plates having integral eaars overlapping the mounting surfaces of said support posts.

5. The wall construction of claim 4 wherein the openings in the mounting surfaces of said support posts have inclined side edges, and wherein at least some of the integral ears on the face plates of said mounting elements are provided with tabs configured to be received in said openings and to coact in frictional engagement with said side edges.

6. The wall construction of claim 1 wherein said top and bottom members have channel-shaped cross sections defined by a base wall and confronting side walls with peripheral flanges extending inwardly therefrom, said flanges being interrupted adjacent each end of said frame members by opposed lockingnotches.

7. The wall construction of claim 6 wherein each of said connector elements has a resilient tongue arrnged to coact in interlocked engagement with said opposed locking notches.

8. The wall construction of claim 1 wherein said openings have inclined side edges connecting wider upper ends to narrower lower ends, and wherein said connector elements have tabs configured to be received in said openings and to coact in frictional engagement with said side edges.

9. The wall construction of claim 1 wherein said connector elements have tab members vertically lowered into said openings for engagement behind said mounting surfaces.

10. The wall construction of claim 9 wherein the uppermost of said openings extend downwardly from the upper edge of said post, and wherein means are provided for preventing tab members received in said uppermost openings from being vertically removed therefore.

11. The wall construction of claim 10 wherein said means comprises a keeper plate detachably secured to the upper end of said post.

12. The wall construction of claim 10 wherein said means comprises integral extensions on said post which are bendably deformable to overlap said tabs.

* * * * *